343-700 MS AU 251 EX
4/5/88 XR 4,736,207

United States Patent [19]
Siikarla et al.

[11] Patent Number: 4,736,207
[45] Date of Patent: Apr. 5, 1988

[54] TAG DEVICE AND METHOD FOR ELECTRONIC ARTICLE SURVEILLANCE

[75] Inventors: Risto Siikarla, Boca Raton; George G. Pinneo, Ft. Lauderdale; Douglas A. Narlow, Coral Springs, all of Fla.

[73] Assignee: Sensormatic Electronics Corporation, Deerfield Beach, Fla.

[21] Appl. No.: 824,507

[22] Filed: Jan. 31, 1986

[51] Int. Cl.[4] ..... G08B 13/24
[52] U.S. Cl. ..... 343/895; 340/572; 343/700 MS
[58] Field of Search ..... 343/701, 873, 895, 700 MS; 340/570, 572

[56] References Cited

U.S. PATENT DOCUMENTS

| | | | |
|---|---|---|---|
| 3,967,161 | 6/1976 | Lichtblau | 340/572 |
| 4,413,254 | 11/1983 | Pinneo et al. | 340/572 |
| 4,567,473 | 1/1986 | Lichtblau | 340/572 |
| 4,642,640 | 2/1987 | Woolsey et al. | 342/42 |

FOREIGN PATENT DOCUMENTS

| | | | |
|---|---|---|---|
| 2105952 | 3/1983 | United Kingdom | 340/572 |

*Primary Examiner*—William L. Sikes
*Assistant Examiner*—Doris J. Johnson
*Attorney, Agent, or Firm*—Robin, Blecker & Daley

[57] ABSTRACT

A method is disclosed for effecting electronic article surveillance with a first high frequency signal and a second lower frequency signal, the second signal having a modulation characteristic therewith. Generally rectangular tag devices are attached to said articles for receipt of such signals and for reradiation thereof. The method involves the fabrication of the tag devices by the steps of: (a) providing first and second circuit elements to be of type exhibiting fixed inductive and capacitive reactances; (b) providing a third circuit element to be of type exhibiting voltage dependent capacitive reactance and forming an electrical series circuit of the first, second and third circuit elements; and (c) configuring the first and second circuit elements with respective geometric diversities, whereby the first circuit element extends longitudinally of the device and is of first transverse dimension, and whereby the second circuit element extends longitudinally of the device at least in part jointly spacedly with the first circuit element and is of second transverse dimension substantially exceeding the first transverse dimension, thus effecting predominant different receipt by the first and second circuit elements of the first and second frequency transmitted signals.

19 Claims, 4 Drawing Sheets

TAG DEVICE AND METHOD FOR ELECTRONIC ARTICLE SURVEILLANCE

FIELD OF THE INVENTION

This invention relates generally to tag devices and methods for use in electronic article surveillance and pertains more particularly to the provision of improved such tag devices responsive to plural diverse frequency incident energy and practices for fabricating the same.

BACKGROUND OF THE INVENTION

The electronic article surveillance (EAS) industry has looked at large to tag devices of a type involving a dipole antenna housed with a diode in a protective envelope of insulative material. In some instances, EAS systems have provided for the transmission of a high frequency signal, such as a 915 megahertz carrier, and of a lower frequency signal, such as modulated 100 kilohertz. Widespread understanding, as evidenced in Pinneo et al. U.S. Pat. No. 4,413,254, is that such device defines a so-called "receptor-reradiator", returning to the receiver of the EAS system, the 915 MHz carrier with content related to the lower frequency transmission and its modulation characteristic. Upon detection in the receiver of received signals inclusive of the modulation characteristic in given repetitive succession, an alarm indication is provided. Generally, detection takes place in a controlled zone, i.e., an exit area of a retail establishment, and output alarm indication is that of a tag device being carried therethrough without authorization (undeactivated).

Subsequent to the Pinneo et al. patent development, the art, particularly through research and development supported by the assignee of the Pinneo et al. patent and this application, has realized substantial analytical evaluation of the activity at hand in EAS dipole and diode tag devices. Thus, in Woolsey et al. patent application Ser. No. 488,077, filed on Apr. 25, 1983, an appreciation flowing from such evaluation is stated, i.e., the need for the establishment of circuit parameters which maximize the reception of the various signals transmitted, the need for establishing an inductive tag device character at the high frequency, where length parameters otherwise dictate, and the need of having a resonant circuit in the tag device at the high frequency.

In addressing such discerned needs, the Woolsey et al. application looks to the addition of inductance at 915 MHz selectively, as by a serpentine inductive path providing same within the length constraint at hand. The Woolsey et al. application thus looks not to the simple dipole/diode combination but to a discernment of specific diversely characterized tag device areas. The device of the Woolsey application thus provides a generally rectangular tag configuration and devotes area to a circuit element, which is inductive at the high frequency and is capacitive up to the lower frequency, and devotes other area to another circuit element, which is inductive at the high frequency, such circuit elements being physically disparate in geometry and arranged in electrical series circuit with the diode. In particular, Woolsey et al. recognize that the sum of the various reactances of the circuit elements and that of the diode should give rise to situations wherein the diode is at the center of a resonant circuit, wherein the net sum of the various reactances at hand across the tag should then be zero and wherein the circuit elements should be addressed generally to different purposes, e.g., that one thereof should be such as to maximize second lower frequency energy receipt and hence voltage applied to the diode.

Apart from the various recognitions of the Woolsey et al. invention, it is the view of the applicants herein that the art has not yet fully realized optimum parameters of tag devices responsive to plural frequency system transmissions.

SUMMARY OF THE INVENTION

The present invention has as its primary object the provision of improved tag devices responsive to plural frequency transmissions.

A more particular object of the invention is the provision of EAS tag devices having improved response to plural frequency transmissions from the viewpoint of tag device area allocation.

Other objects of the invention are the provision of improved EAS practices and methods for fabrication of tag devices thereof.

In attaining the foregoing and other objects, the invention provides a method for effecting electronic article surveillance with a system high frequency signal and a second lower frequency signal, such second signal having a modulation characteristic therewith, and wherein generally rectangular tag devices are attached to said articles for receipt of such transmissions and for reradiation thereof, the method comprising the fabrication of said tag devices by the steps of: (a) providing first and second circuit elements to be of type exhibiting fixed inductive and capacitive reactances; (b) providing a third circuit element to be of a type exhibiting voltage dependent capacitive reactance and forming an electrical series circuit of the first, second and third circuit elements; and (c) configuring the first and second circuit elements with respective geometric diversities, whereby the first circuit element extends longitudinally of the device and is of first transverse dimension, and whereby the second circuit element extends longitudinally of the device at least in part jointly spacedly with the first circuit element and is of second transverse dimension substantially exceeding the first transverse dimension, thus effecting predominantly different receipt by the first and second circuit elements of the first and second frequency transmitted signals.

Desirably, such spacing of the joint longitudinally extending courses of the first and second circuit elements is selected to be of measure such that respective oppositely-directed currents exist in the first and second circuit elements at the first frequency, thereby further effecting said predominant diverse signal receipts thereby.

In other practice in accordance with the invention, following steps (a) and (b) above, step (c) is practiced by configuring the first and second circuit elements with respective geometric diversities, such that the second element predominates in receipt of such second frequency transmitted signals over receipt thereby by the first circuit element, and such that the series circuit is resonant at the first frequency, said step (b) being further praticed by selecting the third circuit element to coordinate the voltage dependent capacitive reactance thereof with the magnitude of second frequency transmitted signals received by the second circuit element to maximize capacitive reactance change in the third circuit element in response to such signals received by the second circuit element.

The foregoing and other objects and features of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
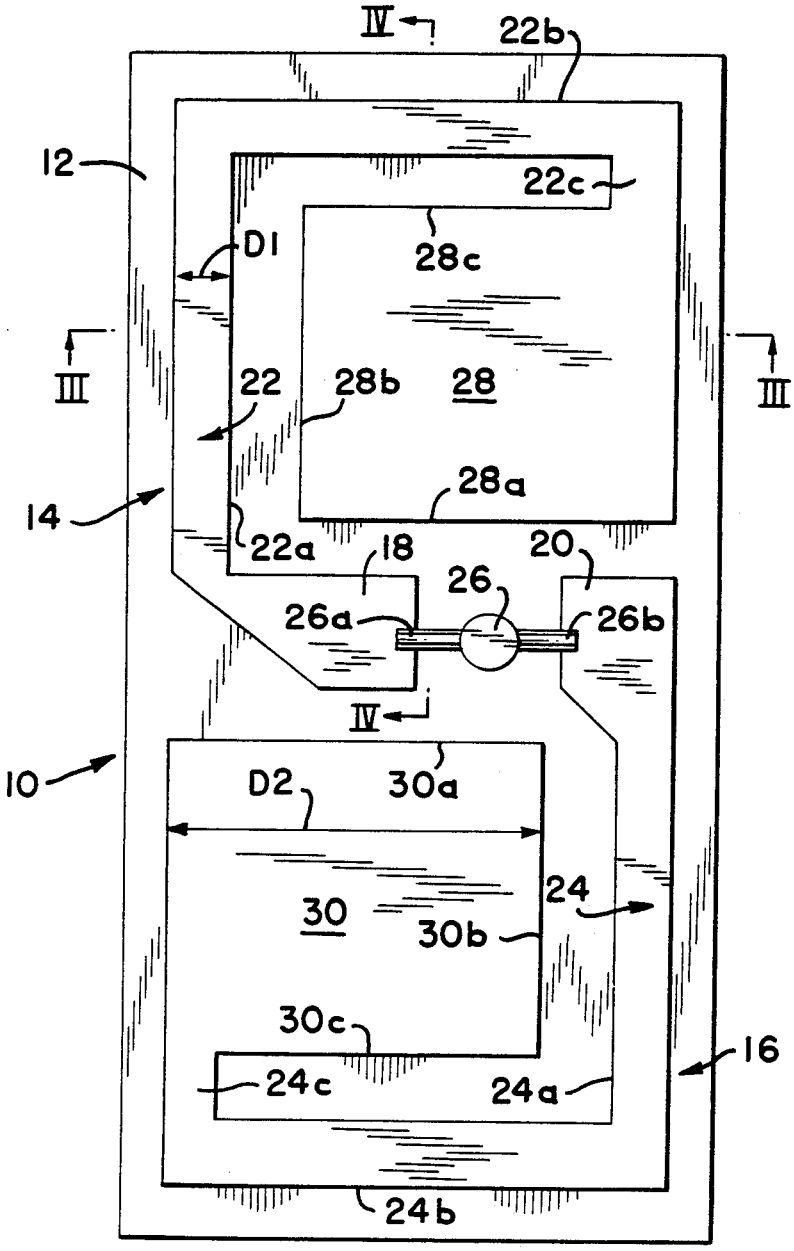
FIG. 1 is a top plan view of a first embodiment of a tag device in accordance with the invention.
Figure 2:
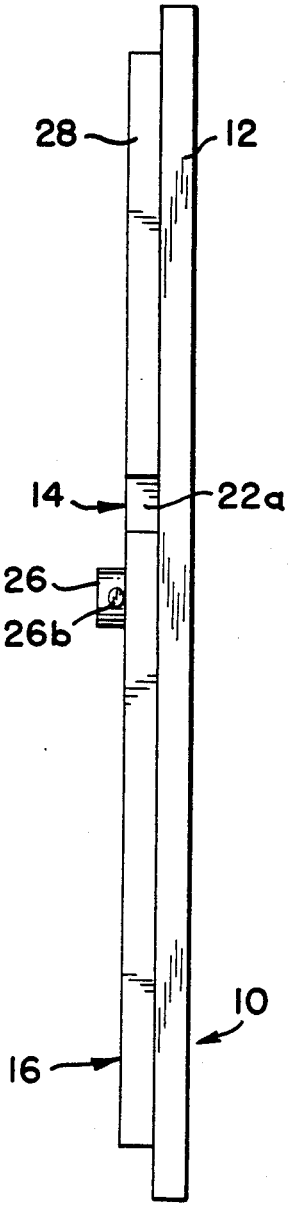
FIG. 2 is a right side elevation of the tag device of FIG. 1.
Figure 3:
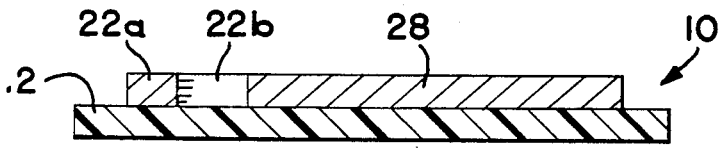
FIG. 3 is a sectional view as would be seen from plane III—III of FIG. 1.
Figure 4:
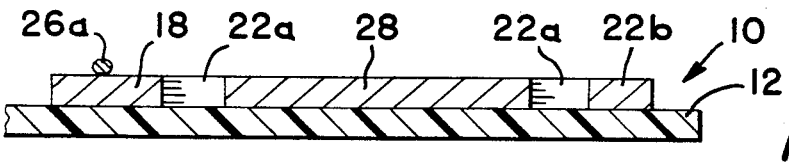
FIG. 4 is a sectional view as would be seen from plane IV—IV of FIG. 1.

Referring to FIGS. 1 through 4, tag device 10 is of generally rectangular configuration and comprises an electrically insulative substrate 12 supporting various electrically conductive members. Such members comprise first circuit elements generally designated as 14 and 16, extending oppositely from the center of device 10 and including respectively transverse wings 18 and 20 and courses 22 and 24 of first transverse dimension D1. Courses 22 and 24 each include longitudinal portions 22*a* and 24*a* extending to opposed ends of substrate 12, transverse portions 22*b* and 24*b* and terminal portions 22*c* and 24*c*. Diode 26 is connected by its leads 26*a* and 26*b* in electrical series circuit with first circuit elements 14 and 16.

The conductive members further include second circuit elements designated as 28 and 30 and of generally square outline and inclusive of respective transverse interior margin parts 28*a* and 30*a*, in spaced parallel relation with wings 18 and 20, respective longitudinal interior margin parts 28*b* and 30*b*, in spaced parallel relation with first circuit element portions 22*a* and 24*a*, and respective transverse outer margin parts 28*c* and 30*c*, in spaced parallel relation with first circuit element portions 22*b* and 24*b*. Second circuit elements 28 and 30 are electrically continuous with terminal portions 22*c* and 24*c* of the first circuit elements 22 and 24.

The transverse dimension of second circuit elements 28 and 30, indicated at D2, is substantially in excess of the transverse dimension D1 of first circuit elements 22 and 24, typically some five or more times D1, the geometric diversities of such circuit elements being assigned with a view toward providing selective different fixed inductive and capacitive reactances therein at the first and second frequencies received by tag device 10.

In this connection, second circuit elements 28 and 30 are dedicated or allocated, within the real estate constraints of tag device 10, to the reception of energy at the second transmitted system frequency (lower frequency) with modulation characteristic, for application thereof to diode 26. On the other hand, first circuit elements 22 and 24 have configuration selected such as to render the full series circuit of tag device 10, i.e., second circuit elements 28 and 30, diode 26 and first circuit elements 22 and 24, resonant at the first or high (microwave) frequency.

Circuit element configuration in accordance with the invention is also practiced with a view further to effect the predominant different frequency receptive character of the components of the tag device. Thus, a mutual coaction is desirably provided as between the first and second circuit elements for such purpose. In FIG. 1, with second circuit element longitudinal interior margin parts 28*b* and 30*b* in spaced parallel relation with first circuit element portions 22*a* and 24*a*, and respective transverse second circuit element outer margin parts 28*c* and 30*c* in spaced parallel relation with first circuit element portions 22*b* and 24*b*, respectively oppositely-directed edge-coupled mode currents are produced in the first and second circuit elements upon system transmission receipt by the tag device.

In another finding of the present invention, it has been determined that particular characteristics of the central (third) tag device circuit element are of significance to tag device response in the type of system under discussion, i.e., of plural transmitted frequency variety. In particular, it has been found that the voltage-dependent character of the third circuit element, heretofore known to be a diode, with respect to its capacitance change, is of consequence. The art, to date, has found diodes to be generally usable, for example, see the Pinneo et al. patent proposal for usage of any one of Schottky, junction or PIN diodes.

In accordance with the invention, it has been determined that the third circuit element is of consequence particularly in connection with its capacitance change as selected in correlation with the magnitude of energy receipt at second lower frequency by the tag device second circuit element. In contrast to other diodes, the PIN diode has such characteristic. Thus, given that the tag device is resonant at the first frequency, transitions occur as respects third circuit element capacitance with second frequency voltage excursions and this gives rise to phase shift reversals in the third circuit element.

These findings of the invention will be further understood from consideration of FIGS. 5–8(*b*) in which various equivalent electrical circuits of the tag device are shown.

Figure 5:
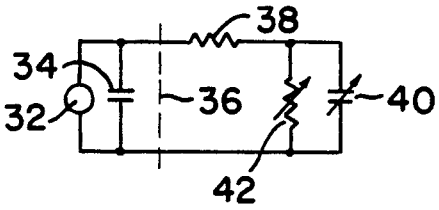
FIGS. 5, 6(*a*), 7(*a*)-(*b*), 8(*a*) and 8(*b*) show various tag device equivalent electrical circuits.

Referring to FIG. 5, same shows an equivalent circuit of the tag device generally in response to receipt of the lower frequency signal, as represented by reference numeral 32, comprising the voltage of second circuit elements 28 and 30 impressed across the tag device. At the lower frequency, the first and second circuit elements, which also comprise a dipole antenna, define essentially a pure capacitor 34, typically of the order of 1 pF, giving rise to a capacitive reactance of 1.6 megohms at the lower frequency. Line 36 has the antenna leftwardly thereof and the remainder of the tag device rightwardly thereof. The diode has a small substrate series resistance 38, on the order of two to four ohms, insignificant at the lower frequency.

Diode capacitance 40, which is a function of applied voltage, is thus shown as variable. The capacitance range may vary, for example, from 0.5 to 5 pF, resulting in capacitive reactance change from 3.2 megohms to 320,000 ohms at the lower frequency, a change approximately of an order of magnitude.

Resistance 42 is the diode resistance, also a function of applied second frequency voltage, and may vary from 10 megohms to 10,000 ohms. The so-called Q-factor is dependent on the capacitances 34 and 40 and resistance 42 and is principally dependent on resistance 42, which should be maximized.

Figure 6A:
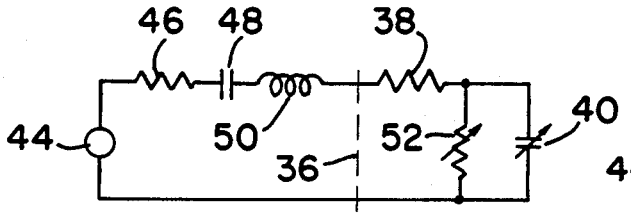
Figure 6B:
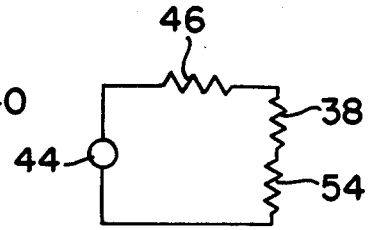

The equivalent circuit of FIG. 6(*a*) represents the tag device of the invention generally in response to receipt of the high frequency signal, as represented by reference numeral 44. Within length constraints on the antenna of tag device 10, it is electrically of insufficient length at the first high frequency signal, and defines an equivalent circuit inclusive of resistance 46 and capacitance 48 and inductance 50, constituted by first circuit elements 14 and 16, and second circuit elements 28 and 30. Resistance 38 is significant at the first high frequency, due to low impedance levels on each side of the diode.

Resistance 52 is the dynamic resistance of the diode and, unlike diode substrate resistance, is a function of applied voltage. The absolute value, however, is quite different, varying from 1 megohm to 1 kilohm. The Q-factor is directly affected by resistance 52, which should thus be as high as possible.

FIG. 6(*b*) is a simplified version of the FIG. 6(*a*) equivalent circuit, resistance 54 being the equivalent series component of parallel resistance 52. As is seen, the reactances of capacitance 48 and inductance 50 cancel one another and the tag device is resonant and resistive at such first high frequency.

Figure 7A:
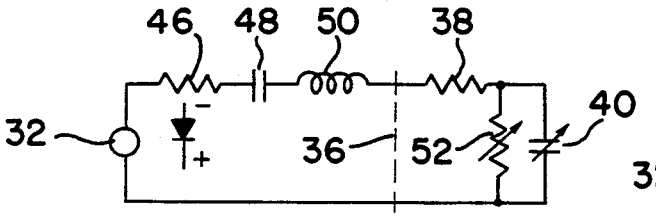
Figure 7B:
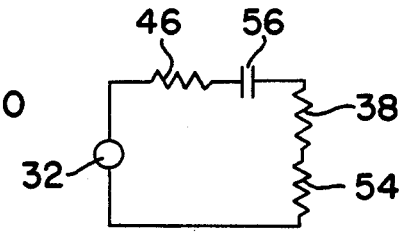

In FIG. 7(*a*) is shown the equivalent circuit of the tag device at the lower frequency under its half-cycles wherein the diode is reverse-biased. The value of diode capacitance 40 is at minimum, giving rise to maximum capacitive reactance, which exceeds the inductive reactance of inductance 50. The tag device thus is capacitive, the uncancelled capacitive reactance being indicated by capacitance 56 is the simplified equivalent circuit of FIG. 7(*b*).

Figure 8A:
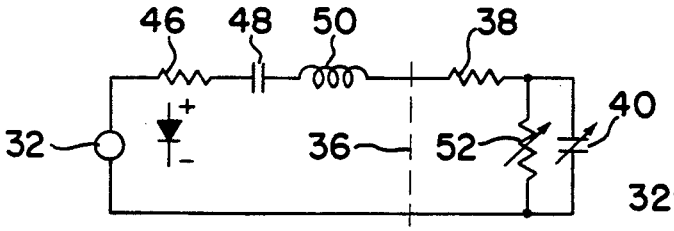
Figure 8B:
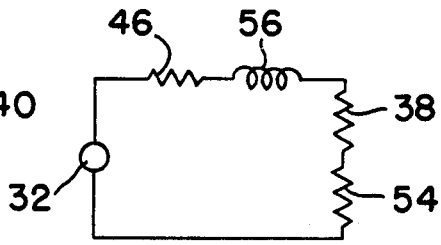

FIG. 8(*a*) shows the equivalent circuit of the tag device at the lower frequency under its half cycles wherein the diode is forward-biased. Here, diode capacitance 40 is at maximum, and the tag device capacitive reactance is at minimum. The tag device is now inductive, the uncancelled inductive reactance being indicated by inductance 56 in the simplified equivalent circuit of FIG. 8(*b*).

The events of FIGS. 7(*a*) and 8(*a*) are cyclic with the lower frequency and the attendant phase reversal of load impedance produces sidebands for detection in the system receiver. The high frequency carrier is of course reradiated through the activity in FIG. 6(*a*).

Figure 9:
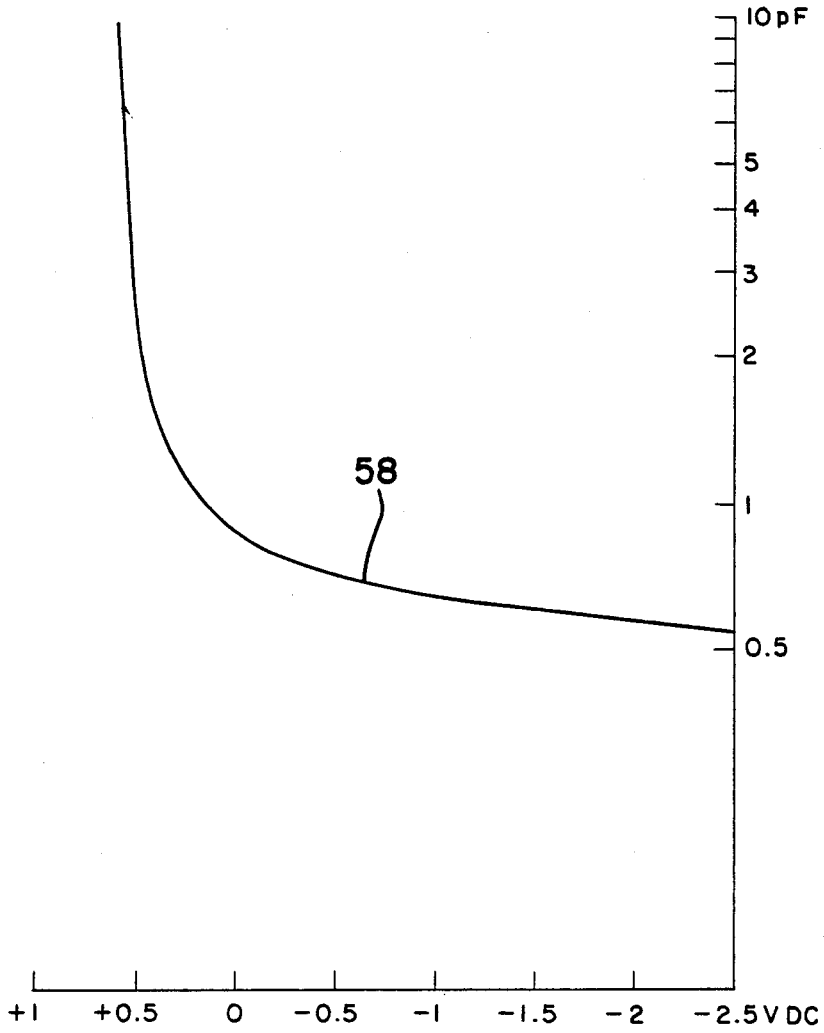
FIG. 9 is a plot of capacitance and voltage.

FIG. 9 depicts a plot of a desired characteristic for the tag device central or third circuit element, discussed to this point as PIN diode 26. Curve 58 indicates third circuit element capacitance variation in relation to voltage thereacross. For negative applied voltage, capacitance is in the range of from about 0.55 pF to about 0.9 pF, for voltage change of two and one-half volts. Substantially greater change is seen for positive applied voltage.

Of particular interest is the voltage range which corresponds to voltage generated in the tag device in response to the lower frequency signal, typically plus and minus one-half volt. The negative excursion has associated therewith capacitance change from 0.75 pF to 0.9 pF. The positive excursion has associated therewith capacitance change from 0.9 pF to 3.5 pF. The capacitive ratio change is approximately four-fold. With an excursion of minus six-tenths to plus six-tenths, the capacitance ratio change is more than an order of magnitude.

In fabricating tag devices of the invention, one correlates the tag capability for voltage generation at the lower frequency with capacitance change of the third circuit element, and vice versa, to enhance the magnitude of the phase reversals, above discussed, which generate the sidebands.

Figure 10:
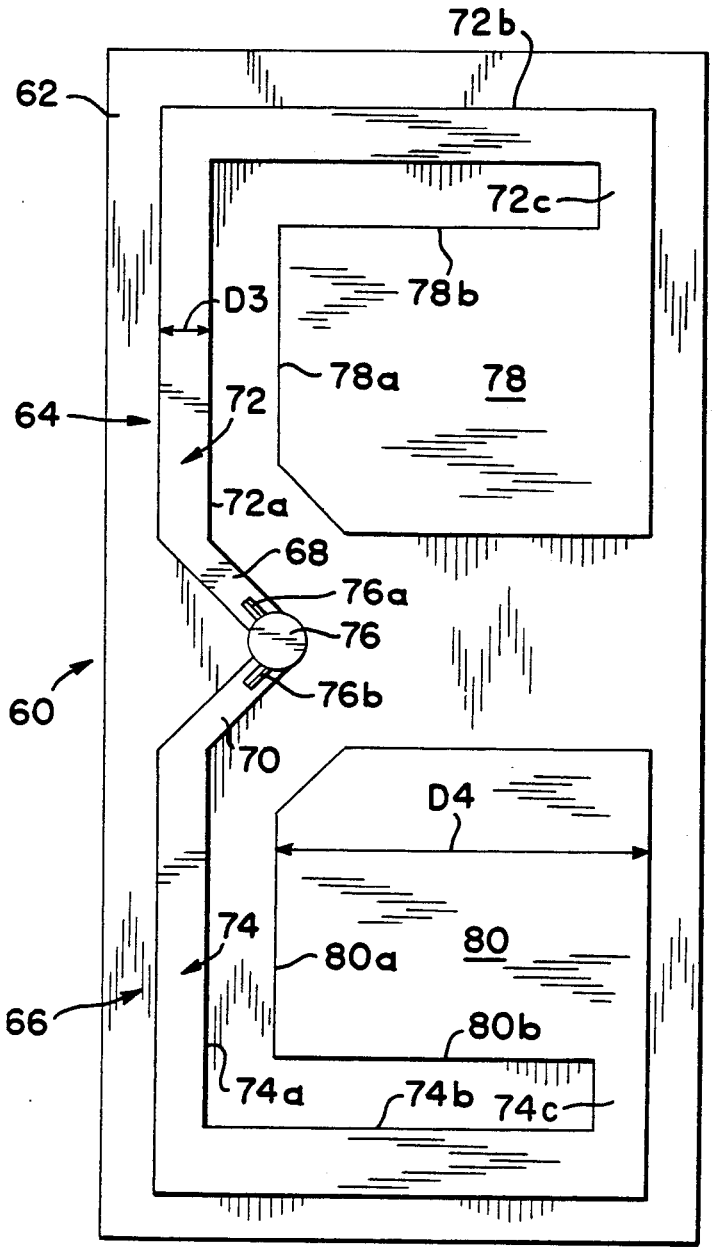
FIG. 10 is a top plan view of a second embodiment of a tag device in accordance with the invention.
Figure 11:
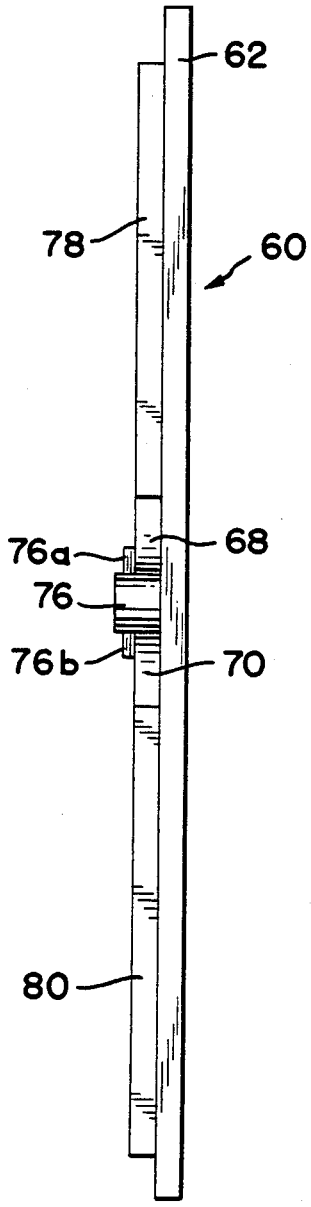
FIG. 11 is a right side elevation of the tag device of FIG. 10.

Referring to FIGS. 10 and 11, tag device 60 is of generally rectangular configuration and comprises an electrically insulative substrate 62 supporting various electrically conductive members. Such members comprise first circuit elements generally designated as 64 and 66, extending oppositely from the center of device 60 and including respectively angled wings 68 and 70 and courses 72 and 74 of first transverse dimension D3. Courses 72 and 74 each include longitudinal portions 72*a* and 74*a* extending to opposed ends of substrate 62, transverse portions 72*b* and 74*b* and terminal portions 72*c* and 74*c*. Diode 76 is connected by its leads 76*a* and 76*b* electrical series circuit with first circuit elements 64 and 66.

The conductive members further include second circuit elements designated as 78 and 80 and of generally square outline and inclusive of respective longitudinal interior margin parts 78*a* and 80*a*, in spaced parallel relation with first circuit element portions 72*a* and 74*a*, and respective transverse outer margin parts 78*b* and 80*b*, in spaced parallel relation with first circuit element portions 72*b* and 74*b*. Second circuit elements 78 and 80 are electrically continuous with terminal portions 72*c* and 74*c* of first circuit elements 72 and 74.

The transverse dimension of second circuit elements 78 and 80, indicated at D4, is substantially in excess of the transverse dimension D3 of first circuit elements 72 and 74, typically some five or more times D3, the geometric diversities of such circuit elements being assigned as in tag device 10, with a view toward providing selective different fixed inductive and capacitive reactances therein at the first and second frequencies received by tag device 60.

An overlying insulative layer (not shown) is secured to each of insulative substrates 12 (FIG. 1) and 62 (FIG. 10) and provision is made for suitably deactivating the tag devices, as by providing access to the conductive members for applying a destructive energy pulse to the diode or other third circuit element.

Various changes to the foregoing tag devices and modifications in the described practices may be introduced without departing from the invention. The particularly preferred methods and apparatus are thus intended in an illustrative and not limiting sense. The true spirit and scope of the invention is set forth in the following claims.

We claim:

1. In combination, in an elongate tag device for use in a surveillance system for receipt of and concurrent response to a first high frequency signal and a second lower frequency signal transmitted by such system, first and second circuit elements mutually separate, electrically series-connected and of respective different geometries for predominant receipt thereby of said first and second frequency transmitted signals, said first and second circuit elements further being mutually coactive along facing longitudinal extents thereof for enhancing such predominant signal receipts thereby.

2. The invention claimed in claim 1 further including a generally rectangular substrate supporting said first and second circuit elements.

3. The invention claimed in claim 2 wherein said first circuit element extends longitudinally of said substrate and is of first dimension transversely of said substrate.

4. The invention claimed in claim 3 wherein said second circuit element extends longitudinally of said substrate and is of second dimension transversely of said substrate, said second dimension substantially exceeding said first dimension.

5. The invention claimed in claim 4 wherein said first circuit element and said second circuit element extend in mutually spaced facing relation longitudinally of said substrate, such spacing being of measure providing for respective oppositely-directed currents therein at said first frequency, thereby effecting such enhancement of said predominant signal receipts thereby.

6. The invention claimed in claim 2 wherein said first circuit element includes first and second portions extending longitudinally of said substrate respectively toward opposed ends of said substrate, each of said first and second portions being of first dimension transversely of said substrate.

7. The invention claimed in claim 6 wherein said second circuit element includes first and second parts extending longitudinally of said substrate respectively toward said opposed ends of said substrate, each of said first and second parts being of second dimension transversely of said substrate, said second dimension substantially exceeding said first dimension.

8. The invention claimed in claim 7 wherein said first portion of said first circuit element and said first part of said second circuit element extend in mutually spaced facing relation longitudinally of said substrate, and wherein said second portion of said first circuit element and said second part of said second circuit element extend in mutually spaced facing relation longitudinally of said substrate, each such spacing being of measure providing for respective oppositely-directed currents in said first and second circuit elements at said first frequency, thereby effecting such enhancement of said predominant signal receipts thereby.

9. The invention claimed in claim 8 further including means for electrically interconnecting said first and second portions of said first circuit element, said means exhibiting capacitive reactance dependent upon voltage applied thereto.

10. The invention claimed in claim 9 wherein said means comprises a PIN diode.

11. The invention claimed in claim 1 further including means for defining a series electrical circuit with said first and second circuit elements, said means exhibiting capacitive reactance dependent upon voltage applied thereto.

12. The invention claimed in claim 11 wherein said means comprises a PIN diode.

13. A tag device for use in a surveillance system for receipt of and concurrent response to a first high frequency signal and a second lower frequency signal transmitted by such system, said tag device being of generally rectangular configuration and comprising a first circuit element extending longitudinally of said device and being of first transverse dimension, a second circuit element extending longitudinally of said device at least in part jointly with said first circuit element and being of second transverse dimension substantially exceeding said first transverse dimension and effecting predominant different receipt by said first and second circuit elements of said first and second frequency transmitted signals, and means for exhibiting voltage dependent capacitive reactance connected in electrical series circuit with said first and second circuit elements.

14. The invention claimed in claim 13 wherein said first circuit element includes first and second portions extending longitudinally of said device respectively toward opposed ends thereof, each of said first and second portions being of said first dimension transversely of said substrate.

15. The invention claimed in claim 14 wherein said second circuit element includes first and second parts extending longitudinally of said device respectively toward said opposed ends thereof, each of said first and second parts being of said second dimension transversely of said substrate.

16. The invention claimed in claim 15 wherein said first portion of said first circuit element and said first part of said second circuit element extend in mutually spaced facing relation longitudinally of said device, and wherein said second portion of said first circuit element and said second part of said second circuit element extend in mutually spaced facing relation longitudinally of said device.

17. A method for effecting electronic article surveillance with a system of a type having transmissions inclusive of a first high frequency signal and a second lower frequency signal, such second signal having a modulation characteristic therewith, and wherein generally rectangular tag devices are attached to said articles for receipt of said transmissions and for reradiation concurrently of said first and second signals thereof, said method comprising the fabrication of said tag devices by the steps of:

(a) providing first and second circuit elements to be of a type exhibiting fixed inductive and capacitive reactances;

(b) providing a third circuit element to be of type exhibiting voltage dependent capacitive reactance and forming an electrical series circuit with said first, second and third circuit elements; and (c) configuring said first and second circuit elements with respective geometric diversities, such that said second circuit element predominates in receipt of said second frequency transmitted signals over receipt thereby by said first circuit element, and such that said series circuit is resonant at said first frequency said step (b) being further practiced by selecting said third circuit element to coordinate the voltage dependent capacitive reactance thereof with said second frequency transmitted signals received by said second circuit element to enhance capacitive reactance change in said third circuit element in response to such signals received by said second circuit element.

18. A method for effecting electronic article surveillance with a system of type having transmissions inclusive of a first high frequency signal and a second lower frequency signal, such second signal having a modulation characteristic therewith, and wherein generally rectangular tag devices are attached to said articles for receipt of said transmissions and for reradiation concurrently of said first and second signals thereof, said method comprising the fabrication of said tag devices by the steps of:

(a) providing first and second circuit elements to be of type exhibiting fixed inductive and capacitive reactances;

(b) providing a third circuit element to be of type exhibiting voltage dependent capacitive reactance and forming an electrical series circuit with said first, second and third circuit elements; and (c) configuring said first and second circuit elements with respective geometric diversities, whereby said first circuit element extends longitudinally of said device and is of first transverse dimension, and whereby said second circuit element extends longitudinally of said device at least in part jointly spacedly with said first circuit element and is of second transverse dimension substantially exceeding said first transverse dimension to effect predominant different receipt by said first and second circuit elements of said first and second frequency transmitted signals.

19. The invention claimed in claim 18 wherein said spacing between said joint longitudinally extending first and second circuit elements is selected to be of measure such that respective oppositely-directed currents exist in said first and second circuit elements at said first frequency, thereby further effecting said predominant signal receipts thereby.

* * * * *